US008567629B2

(12) United States Patent
VanDamme et al.

(10) Patent No.: US 8,567,629 B2
(45) Date of Patent: Oct. 29, 2013

(54) FOOD PACKAGING WITH A LID AND CLOSURE SYSTEM FOR PACKAGING

(75) Inventors: Patrick VanDamme, Lomme (FR); Frederic Bourdin, Meyzieu (FR); Francis Lovell, Montreuil (FR)

(73) Assignee: Compagnie Gervais Danone, Paris (FR)

( * ) Notice: Subject to any disclaimer, the term of this patent is extended or adjusted under 35 U.S.C. 154(b) by 0 days.

(21) Appl. No.: 13/525,728

(22) Filed: Jun. 18, 2012

(65) Prior Publication Data

US 2012/0248132 A1 Oct. 4, 2012

Related U.S. Application Data

(63) Continuation of application No. 12/808,532, filed on Jun. 16, 2010, now abandoned.

(30) Foreign Application Priority Data

| | | |
|---|---|---|
| Dec. 19, 2007 | (FR) | 07 08877 |
| Dec. 19, 2007 | (FR) | 07 08878 |
| Dec. 19, 2007 | (FR) | 07 08879 |
| Dec. 18, 2008 | (WO) | PCT/FR2008/052359 |

(51) Int. Cl.

| | |
|---|---|
| ***B65D 51/00*** | (2006.01) |
| ***B65D 43/16*** | (2006.01) |
| ***A47G 19/06*** | (2006.01) |

(52) U.S. Cl.
USPC ..... 220/212; 220/254.3; 220/574.1

(58) Field of Classification Search
USPC ..... 220/212, 254.3, 254.5, 326, 833–835, 220/839; 215/235, 237
See application file for complete search history.

(56) References Cited

U.S. PATENT DOCUMENTS

| | | | | |
|---|---|---|---|---|
| 4,300,008 | A * | 11/1981 | McCaulay | 585/360 |
| 4,346,812 | A * | 8/1982 | Banich, Sr. | 215/352 |
| 2006/0191933 | A1 * | 8/2006 | Hicks et al. | 220/254.3 |
| 2006/0219652 | A1 * | 10/2006 | Grant et al. | 215/237 |
| 2012/0279964 | A1 * | 11/2012 | McGeough | 220/212 |

FOREIGN PATENT DOCUMENTS

| | | | |
|---|---|---|---|
| DE | 200 21 262 | | 4/2001 |
| EP | 1 157 936 | | 11/2001 |
| EP | 1 512 637 | | 3/2005 |
| FR | 2 747 107 | | 4/1996 |
| GB | 2 318 784 | | 5/1998 |
| JP | 10278962 | A * | 10/1998 |
| WO | 2007/010174 | | 1/2007 |
| WO | WO 2008075314 | A1 * | 6/2008 |

OTHER PUBLICATIONS

European Search Report for EP 2 388 206, pp. 16-18, Sep. 8, 2011.

* cited by examiner

*Primary Examiner* — Anthony Stashick
*Assistant Examiner* — James N Smalley
(74) *Attorney, Agent, or Firm* — McDonnell Boehnen Hulbert & Berghoff LLP

(57) ABSTRACT

The packaging for a food product is provided with a container having an upper opening. An annular frame that is mounted as a close fit on the container has an upper face provided with an annular projection extending in the continuation of the interior face of the frame. A lid mounted articulated with respect to the frame is adapted to close off the opening, the lid having a top wall, a side wall and an interior skirt, a continuous groove being defined between the side wall and the interior skirt. A measuring utensil with a bowl is stored between the opening of the container and the lid in the closed position. The annular projection is inserted into the continuous groove and the interior skirt presses at least partially against said interior face of the frame in the closed position of the lid.

14 Claims, 4 Drawing Sheets

FOOD PACKAGING WITH A LID AND CLOSURE SYSTEM FOR PACKAGING

CROSS-REFERENCE TO RELATED APPLICATIONS

This application is a continuation of U.S. patent application Ser. No. 12/808,532, filed Jun. 16, 2016, which is a National Stage Entry of International Patent Application No. PCT/FR2008/052359, filed Dec. 18, 2008, and which in turn claims priority to French Patent Application No. 0708877, filed Dec. 19, 2007, French Patent Application No. 0708878, filed Dec. 19, 2007, and French Patent Application No. 0708879, filed on Dec. 19, 2007, the disclosures which are incorporated by reference in their entirety.

FIELD OF THE INVENTION

The present invention relates to a resealable packaging intended in particular for a food product in powder form, which comprises a device for locking the closure system. More specifically, the invention relates to packaging comprising:

- a container extending along a central axis from a base as far as an upper face that has an opening delimited by a surround;
- a closure system comprising a lid mounted articulated relative to the container between an open position and a closed position in which it closes off the opening; and
- a locking device for locking the lid in the closed position and comprising a locking plate connected to the lid and an engagement rim secured to the surround, the locking plate being able to pivot about an axis (for example a substantially horizontal axis, the central axis being typically vertical) between an engagement position and an unlocked position, and having, on either side of the axis, an actuating portion and a catching portion which extend as far as respective free ends, the locking plate pivoting from the engagement position in which the catching portion engages with the engagement rim in the closed position, into the unlocked position as a result of manual actuation of the actuating portion towards the central axis.

Locking such as this, achieved by engagement between the catching portion and the engagement rim is generally firm enough to keep the lid in the closed position even if the packaging is dropped, and this is not always the case with a lid the interior periphery of which is simply pushed onto the neck of the container using friction to hold it in place. Furthermore, the locking plate remains simple and intuitive enough to manipulate that it remains convenient enough to use.

BACKGROUND OF THE INVENTION

A locking device such as this is disclosed for example in document WO 2005/075314. The packaging described in that document does not very well incorporate the locking device into the volume of the container. In that packaging, the plate projects from the volume of the lid. In order to limit as far as possible how much of the plate projects, the height of the actuating portion is relatively small.

This greatly limits the travel of the plate and means that precisely-controlled actions are required. This also gives the user the impression that the plate is very hard to operate.

In addition, this embodiment does not limit the risks of the locking plate becoming unlocked or even damaged during transport.

There is therefore a need for packagings that retain a compact appearance and in which the lid and the associated locking mechanism are easy to operate.

BRIEF SUMMARY OF THE INVENTION

It is therefore an object of the present invention to provide a locking device that is improved, both in terms of ease of operation and in terms of secureness of action.

To this end, the invention proposes packaging of the aforementioned type, in which the lid has a side wall of a height at least equal to the height of the actuating portion and an upper face that has a depression opening into the side wall, and wherein the actuating portion of the locking plate lies level with the mouth of the depression and pivots into this depression to adopt the unlocked position, the catching portion of the locking plate disengaging radially towards the outside of the engagement rim.

Thus it becomes possible to obtain a locking plate with ease of operation that is incorporated into the height of the lid and has a significant freedom of pivoting thanks to the depression in the lid. Arranging the locking plate facing a depression in the lid in this way means that this locking plate does not protrude above the top of the lid and forms part of the overall exterior volume of the lid.

As a preference, the articulated lid is fairly tall (for example between 2 and 5 cm tall) and has a side wall that makes it easier to operate. One or more items can then be stored in the volume defined by the lid.

According to another specific feature, the locking plate extends in the continuation of the side wall of the lid in the engagement position. Thus, the lid has an outline with no projections and a plurality of packaging closure systems can be stacked.

According to another specific feature, the free end of the actuating portion is at least three times further away from the pivot axis than is the free end of the catching portion. This then advantageously yields a lever effect during the unlocking operation.

According to another specific feature, the closure system comprises an elastic hinge which comprises two hinge elements between which there is formed a gap f adjacent to the depression, the engagement rim being inserted into the gap and pressing against the side wall of the lid in the closed position.

According to another specific feature, the catching portion comprises at least one peg directed radially inwards with respect to the central axis and engaging with the engagement rim in locked position so as, in the locked position, to prevent any translational movement of the locking plate in a direction orthogonal to the pivot axis.

According to another specific feature, the actuating portion has an exterior face with at least one projecting rib. This rib may be positioned some distance from the free end of the actuating portion, with a shape similar to the outline of this free end. The digit used during manual operation will then not be able to slip beyond the rib and will therefore be placed in an optimum position (for example in the middle of the actuating portion) for comfortable operation.

According to another specific feature, the locking plate is associated with at least one tamper-evident feature indicating that the closure system has been tampered with prior to first opening, the tamper-evident feature being connected by a first frangible connection to a lateral edge of the plate and by a second connection to an edge formed between a face of the depression and the side wall of the lid.

According to another specific feature, the locking plate is of planar shape in the region of its actuating portion.

According to another specific feature, the locking plate and the lid are obtained as a single component using injection moulding.

A further object of the invention is to provide a closure system that is easy to lock and to unlock.

To this end, the invention proposes a closure system comprising the surround and the lid of the packaging, wherein the surround and the lid form a single assembly (preferably a one-piece assembly) intended to be fitted onto the top of a packaging.

Independently or in combination with above mentioned, and with understanding that examples and details of realization hereafter described each can be used in isolation, the present invention here relates to packaging with a resealable closure lid intended for a food product. More specifically, the invention relates to packaging comprising:

- a container extending along a central axis from a base as far as an upper face which has an opening delimited by a surround, the surround having an interior face; and
- a closure system comprising a lid mounted articulated with respect to the container between an open position and a closed position in which it closes off the opening of the container, the lid having a top wall.

This type of packaging has a closure system that is easy to use and is commonly employed in the field of food products, for example to contain food products in the form of powder, granules or flakes. Document FR 2 747 107 A1 describes an example of food packaging of this kind with the lid articulated via an elastic hinge to a surround covering the top of the container. The lid externally covers the top periphery of the surround. The lid thus offers a good purchase and is therefore particularly simple to operate. However, with contents in the form of powder, the disadvantage encountered is that powder becomes deposited in the corners or the edges formed under the lid, particularly once the packaging has been inverted, for example during transport.

There is therefore a need for packagings that have a lid that is practical and quick to open and that prevent any product from accumulating in the upper parts of the packaging.

It is here therefore an object of the present invention to provide a resealable packaging that makes the lid easy to operate and that limits, in the region of the closure, all the roughnesses that are liable to collect some of the powder or small-sized particles contained in the packaging.

To this end, the invention proposes a packaging of the aforementioned type, characterized in that the lid has a side wall extending from the top wall and an interior skirt extending from the side wall and some distance from the top wall so as to define with the side wall a continuous groove, in that the surround has an upper face which has an annular projection extending in the continuation of the interior face of the surround, and in that the interior skirt presses at least partially against the interior face of the surround in the closed position.

Thus it becomes possible to obtain a packaging that is ergonomic and can be operated effortlessly, that can be used to contain powdered milk without powder accumulating on the upper rims of the surround or of the container. What happens is that the presence of the interior skirt limits, or even eliminates, the roughnesses in the interior volume of the packaging that are liable to collect powder. If contents in the form of powder or granules of the packaging are thrown against the inside of the closed lid (for example as a result of the container being inverted during transport), there will be no accumulation of powder on top of the container when the packaging is next opened.

In addition, the insertion of the annular projection of the surround into the groove may advantageously play a part in centring the lid at the time of closure. Insertion into this groove may also improve sealing. In addition, the lid may delimit a relatively large interior volume thanks to the fact that the top wall is raised up relative to the groove. This gain in volume under the lid is advantageously obtained with a portion of side wall extending above the groove, thus making it possible to limit the dimensions of the groove and thus save on packaging material.

According to another specific feature, the surround is attached to the container and the closure system comprises a hinge connecting the surround to the lid in an articulated manner, the surround having a profile of a height that decreases gradually away from the hinge.

According to another specific feature, the side wall and the interior skirt meet to form, in vertical section, the arms of a Y. This limits the amount of plastic needed to make the lid.

According to another specific feature, the interior skirt extends beyond the side wall. Thus, closing becomes easier, particularly when the lid has a certain flexibility and a shorter height opposite the hinge, by virtue of the guiding/centring effect afforded by this interior skirt.

According to another specific feature, the surround has an exterior peripheral face with respect to which the annular projection is offset inwards, the side wall of the lid extending in the continuation of the exterior face of the surround in the closed position. Thus, the lid provides an additional volume (particularly heightwise) with respect to the surround, which may allow one or more items to be housed in the volume defined by the lid.

According to another specific feature, the annular projection is of substantially constant height and is positioned obliquely with respect to the top face of the container.

According to another specific feature, the interior skirt has a free end that is chamfered on its outside and fits via its entire periphery against the inside of the surround. This has the effect of making the radial contact between the interior skirt and the interior face of the surround more gradual and less abrupt.

According to another specific feature, the packaging comprises a measuring utensil with a bowl, the surround comprising, preferably on the same side as the hinge, a retaining member with a tab which, with the interior face of the surround, delimits a housing that is open at the top and intended to accommodate a wall portion of the bowl of the measuring utensil, the interior skirt extending, when the lid is in the closed position, up to the vicinity of the housing in order to collaborate with the bowl housed in the housing. This for example allows the bowl to be pushed a little further into the housing as the lid is closed, or alternatively allows the bowl to be partially disengaged from the housing upon opening, but also allows pressure to be applied to the bowl housed in the housing.

According to another specific feature, the lid comprises radial ribs projecting from the interior skirt towards the inside of the lid and that meet the top wall of the lid. The radial ribs towards the central axis stiffen the skirt and encourage centring at the time of closure.

According to another specific feature, the surround has an exterior edge adjacent to the annular projection, the exterior edge of the surround being in contact, when the lid is in the closed position, with the free edge of the side wall, the free edge of the side wall having a width identical to the width of the exterior edge.

The invention also relates to a closure system for packaging, comprising:

an annular surround delimiting an opening, the surround having an interior face;

a lid articulated to the surround and able to move between an open position and a closed position in which it closes off the opening from above, the lid having a top wall;

characterized in that the surround and the lid form a single assembly, the lid having a side wall extending from the top wall and an interior skirt extending from the side wall and some distance from the top wall so as to define with the side wall a continuous groove, in that the surround has an upper face which has an annular projection extending in the continuation of the interior face of the surround, and in that the interior skirt presses at least partially against said interior face of the surround in the closed position. It should be understood that such a closure system, solving powder retention problem, may be used independently of the locking system.

Independently or in combination with above mentioned, and with understanding that examples and details of realization hereafter described each can be used in isolation, the present invention here relates to the field of resealable packages intended in particular for food products. More particularly, the invention relates to a closure system and to a package, the latter comprising:

a container extending along a central axis from a base as far as an upper face that has an opening delimited by a surround, the surround having a radially inner side wall;

a lid that can move between an open position and a closed position in which it closes off the opening;

a measuring utensil that has a bowl connected to a handle sized such that it can be positioned in the plane of the surround.

Document WO 2005/075314, or alternatively, document FR 2 747 107, discloses how to store the spoon by securing it under the lid using two lugs. The handling operations involved in securing and removing this spoon entail finger contact with an interior surface of the lid, this presenting a food hygiene problem because, for example during transport, the contents of the container may come into contact with the interior surfaces of the lid. In addition, it is necessary to touch the projecting back of the spoon in order to extract this spoon from the securing lugs, and this may cause the content (powdered formula milk for example) to become contaminated with germs from that part of the spoon that will be thrust into the contents of the packaging.

Also disclosed, in document EP 1 512 637-A1, is a closure assembly with a lid articulated to a ring mounted on the upper part of a tin, in which a spoon can be stored by securing its handle to the inside of the ring. However, securing and removing the spoons require the spoon to be handled in such a way that the user has to touch the bowl or a region close to the bowl (given the shortness of the handle), thus leading to contamination because the bowl and the part adjacent to the bowl will regularly come into contact with the food in the tin. There is therefore a need for food packagings that allow a measuring utensil to be stored inside them and which limit contact liable to contaminate the food, while at the same time being practical for the user to handle.

It is therefore an object of the present invention to alleviate one or more of the aforementioned disadvantages by providing a resealable package with interior storage of a measuring utensil which reduces the chance for contamination and also provides an answer to the issues of space and practicality.

To this end, the invention proposes a packaging of the aforementioned type, characterized in that the inner side wall of the surround comprises at least one retaining member, which has a base extending from the surround towards the central axis of the container and that is extended by a tab extending upwards some distance from the inner side wall, the retaining member delimiting, with the inner side wall, an insertion housing capable with a small amount of clearance of accommodating a wall portion of the bowl of the measuring utensil, the measuring utensil being kept in an interior storage position along the lid by the retaining member in the closed position.

Thus, using these measures, it becomes possible to house the measuring utensil quickly under the lid before closing this lid, without contact either with the inside of the lid or with the bowl of the utensil because the handle can be accessed directly via its free end.

According to another specific feature, the lid comprises a side wall of tubular shape and a transverse top wall, the tab of the retaining member comprising an upper free end positioned, when the lid is in the closed position, a determined separation in the direction of the central axis away from the top wall of the lid, the determined separation being less than the depth of the bowl.

Thus, the measuring utensil secured to the retaining member cannot rise up inside the closed package and the bowl remains secured to the hook. There is therefore no risk of the measuring utensil dropping down into the container with the food product.

According to another specific feature, the surround is of a height that has a maximum in the region of the side of the retaining member.

Thus, the surround may have a shorter height some distance away from the retaining support/member, thus making the measuring utensil easier to set in place on the hook without touching the edges or the inside of the surround. Setting the utensil in position and extracting it are therefore more intuitive to the user.

According to another specific feature, the tab extends over a height representing from 40 to 80% of the maximum height of the surround According to another specific feature, the surround has a profile the height of which decreases gradually away from the retaining member. Thus, the handle of the bowl can be grasped with a minimum of impediment from the surround, which has a shorter height on the handle side than it does on the bowl side.

According to another specific feature, the height of the surround varies approximately by a factor of 2:1 between its maximum and its minimum.

According to another specific feature, the retaining member comprises at least three bearing zones each applying pressure to a wall portion of the bowl in order to grip the bowl. Thus, the utensil is wedged reliably on just one side.

According to another specific feature, two of the bearing zones are each formed of a rib of the surround protruding towards the central axis. The ribs may be of triangular shape, with their maximum thickness near the entrance to the insertion housing in order to increase the pressure when the bowl is fully inserted into the housing.

According to another specific feature, the lid comprises a tubular interior skirt a part of which extends, when the lid is in the closed position, into the vicinity of the housing. The interior skirt presses radially against an upper part of the inner side wall of the surround and may for example play a part in keeping the bowl in the housing.

In the closed position, the bowl is therefore covered by the lid both from above and acrossways by the interior skirt.

Another object of the invention is to provide a closure system that allows the measuring utensil to be stored in the closure device in a practical way.

To do that, the invention proposes a closure system for packaging, comprising:

a surround extending in a tubular overall shape about a central axis and delimiting an opening, the surround having a radially inner side wall;

a lid articulated to the surround and able to move between an open position and a closed position in which it closes off the opening from above;

a measuring utensil that has a bowl connected to a handle sized such that it can be positioned in the plane of the surround;

characterized in that the inner side wall of the surround comprises at least one retaining member which has a base extending from the surround towards the central axis, the base being extended by a tab extending axially upwards some distance from the inner side wall, the retaining member delimiting, with the inner side wall, an insertion housing capable with a small amount of clearance of accommodating a wall portion of the bowl of the measuring utensil, the measuring utensil being kept in an interior storage position along the lid by the retaining member in the closed position.

These measures advantageously make it possible, with the utensil grasped simply by its handle, for the bowl to be inserted into the insertion housing prior to the closing of the lid or for the bowl to be extracted from the retaining member after the lid has been opened.

It should be understood that such a closure system, solving a storage problem regarding a measuring utensil, may be used independently of the locking system and/or independently of a lid arrangement with an interior skirt.

BRIEF DESCRIPTION OF THE DRAWINGS

Other features and advantages of the invention will become evident from the description which will follow, which is given by way of nonlimiting example with reference to the figures in which.

DETAILED DESCRIPTION OF THE INVENTION

In the various figures, identical references indicate elements that are identical or similar.

Figure 1:
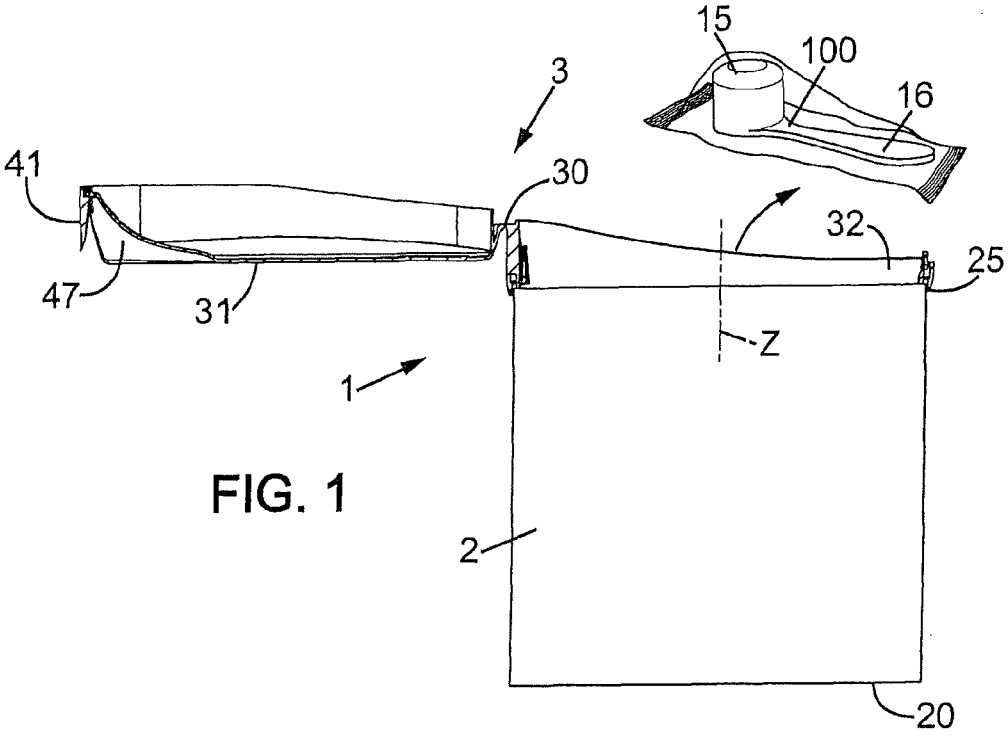
FIG. 1 is a view in section of a packaging according to the invention comprising a locking device and a lid in the open position, and an associated measuring utensil.

With reference to FIG. 1, the packaging 1 comprises a container 2 and a closure system 3. A locking device 4 like the one illustrated particularly in FIGS. 2A and 2B may be fitted to the closure system 3. The container 2 is rigid or semi-rigid, for example made of metal, of cardboard with a food-grade coating or some other material suited to food packaging. This container 2 is open at just one end, the opposite end to its closed end or base 20, and may be of any shape: cylindrical, frustoconical, parallelepipedal, with a constriction, etc., as those skilled in the art will appreciate.

Figure 4:
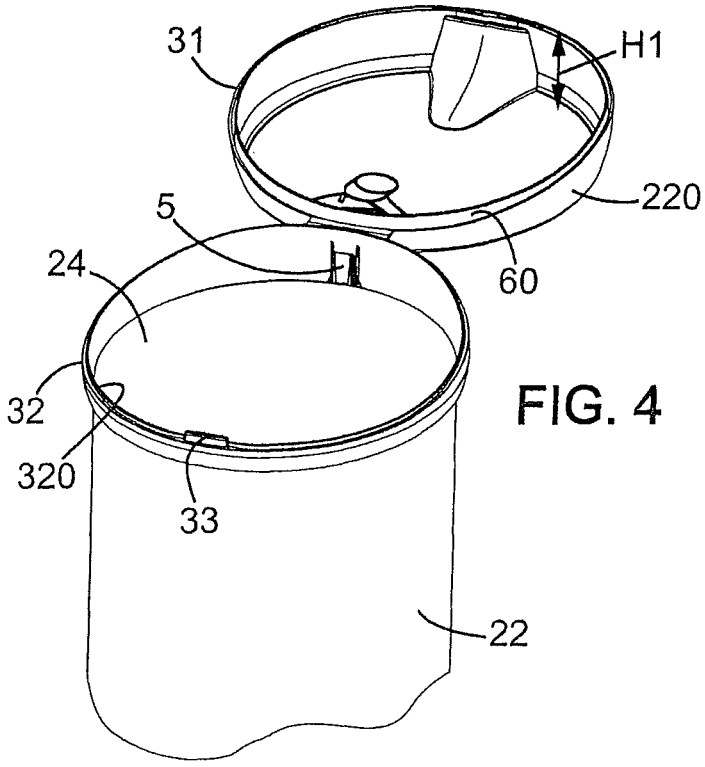
FIG. 4 is a perspective view of the packaging of FIG. 1.
Figure 7:
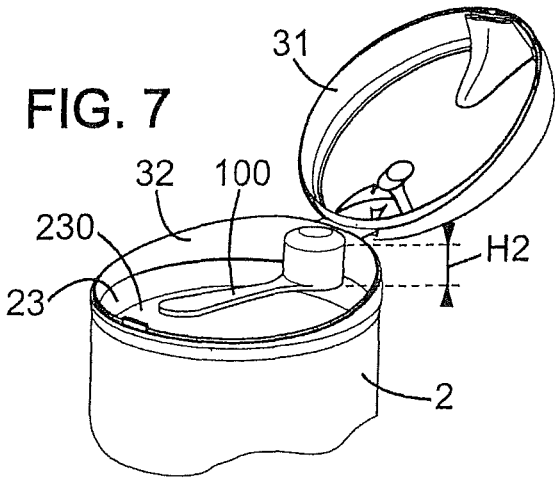
FIG. 7 is a perspective view illustrating how the measuring utensil is secured in the packaging.

The container 2 in the embodiment depicted has a tubular side wall 22 which extends from the base 20 along a vertical central axis Z as far as an upper face 23. In the example of FIGS. 1, 4 and 7, the upper face 23 has a wide opening 230 surrounded by a surround or periphery 25. The container 2 with this wide opening 230 is suited to containing powdered formula milk that has to be removed through the opening using an appropriate utensil. This then is a relatively deep container that requires the opening 230 to be made as wide as possible to make it easier to remove powder from the bottom 20 of the container 2. In particular, the opening 230 and the container 2 may be characterized by substantially identical inside diameters.

When the packaging 1 is being used to contain powdered milk, an inner seal 24, as shown in FIG. 4 and not depicted in FIG. 7, is provided, this being sealed for example around an interior border or onto the periphery 25 of the container 2. Thus, the powdered milk is perfectly preserved in the container 2 until the time of first use, at which point the inner seal 24 is removed.

Figure 8:
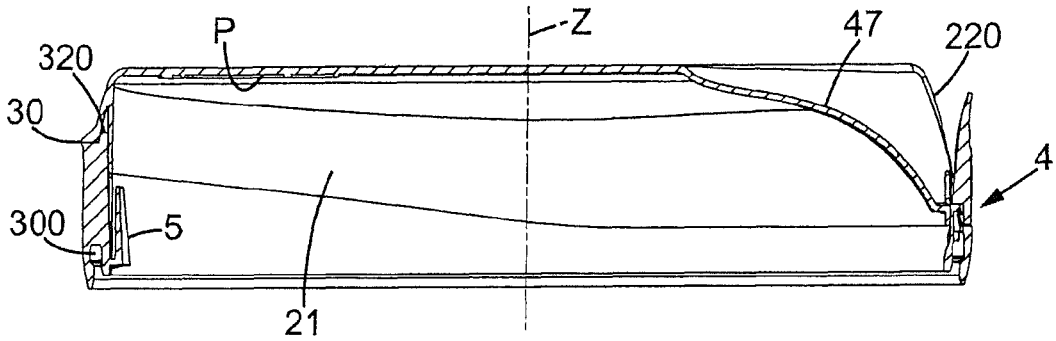
FIG. 8 is a view in section on the plane VIII-VIII of the closure system in the closed position.

With reference to FIGS. 1, 4 and 8, the closure system 3 first of all comprises a lid 31 of relatively domed shape, so that this lid can be considered to have a substantially flat top wall P, that forms the closed end of the lid, and a side wall substantially coaxial with the central axis Z. The lid 31 also has an interior face facing towards the opening 230 in the closed position and which in general terms is shaped like a dish because of the domed shape of the lid 31.

The closure system 3 additionally comprises a frame or surround 32 which delimits the opening 230. In a preferred embodiment, the surround 32 may be mounted as a close fit on an upper part or neck of the container 2. The surround 32 is fixed preferably non-removably to this part of the container 2, particularly by clipping together, but this attachment could equally be afforded by bonding or welding. In the nonlimiting example of FIGS. 8 and 9, a groove 300 accepts and clip-fastens the neck of the container 2. As an alternative, the surround 32 could correspond to an edging that forms an integral part of the container 2.

The opening 230 may be slightly narrowed with respect to the cross section of the container, for example on account of there being a levelling edge. In such a case, the surround 32 may delimit an opening of different dimensions, preferably greater than those of the narrowed opening.

With reference to FIGS. 1, 6, 8 and 9, the lid 31 and the surround 32 are articulated together via a connection that allows the lid 31 to be moved with respect to the surround 32 and to the container 2 between an open position depicted in FIG. 1, in which the opening 230 is largely accessible, and a closed position, depicted in FIG. 8, in which the lid 31 covers this opening. This then is a resealable packaging the lid 31 of which is handled on each occasion, for example for preparing baby bottles.

The connection in this instance is a hinged connection 30 in which the axis of pivoting is perpendicular to the central axis Z. In the embodiment depicted, it is a plastic hinge 30 formed by a fold line, which allows the lid 31 and the surround 32 to be produced as a single component. This then is a component obtained by injecting a plastic, such as polypropylene for example, into a mould. However, the hinged connection 30 could of course be obtained using two separate components assembled with one another, and it is equally possible to provide some other form of connection between the surround 32 and the lid 31. In alternative forms of embodiment in which the surround forms part of the container 2, it will be understood that the lid 31 can then be mounted removably on the upper part or neck of the container 2.

Figure 2A:
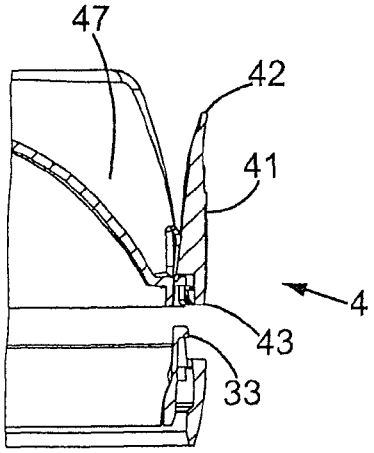
FIGS. 2A and 2B each depict, in the plane of section VIII-VIII of FIG. 5, the locking device with the two parts of this device respectively before and after locking.
Figure 2B:
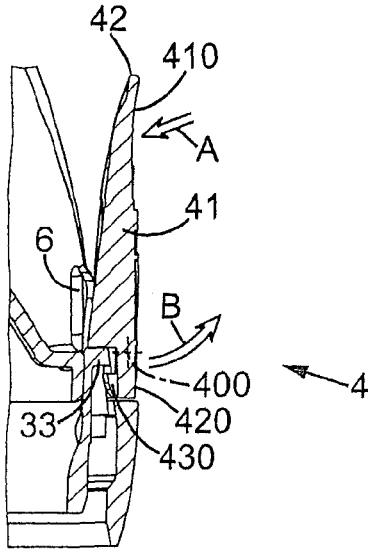

As can be seen in FIGS. 2A and 2B, the surround 32 has a projecting member with an engagement rim 33 used for locking. The locking device 4 comprises, on the lid 31, a locking lug or plate 41 articulated on a pivot axis 400 perpendicular to the central axis Z. The plate 41 has, on each side of the axis 400, an actuating portion 410 and a catching portion 420. The actuating portion 410 extends as far as a first free end 42, that can be gripped from above when the lid 31 is in the closed position, while the catching portion 420 extends in the opposite direction from the pivot axis 400 as far as a second free end 43. When the lid 31 is in the closed position, the plate 41 occupies an engagement position in which the catching portion 420 engages with the engagement rim 33. Unlocking is performed by actuating the actuating portion 410 by hand towards the central axis Z.

By exerting finger or thumb pressure on a preferably central region of the actuating portion 410, as indicated by the arrow A in FIG. 2B, the catching portion 420 is made to withdraw (away from the central axis Z) in the direction of the arrow B. The catching portion 420 can then be moved out of the locking position.

With reference to FIGS. 1, 2A, 2B, 3A and 3B, the annular peripheral portion of the lid comprises a side wall 220 the height of which is at least equal to the height of the actuating portion 410 of the plate 41. The upper face defined by the upper portion of the lid 31 comprises a depression 47 opening into the side wall 220. The depression 47 is formed in the side wall 220 of the lid 31 and may extend as far as the lower end of the lid 31.

The depression 47 is defined by a recessed portion of the top wall P of the lid 31 that has a radially outer mouth delimited by the break in the geometry with the exterior profile of the lid 31 as a whole. It should be noted that the actuating portion 410 of the locking plate 41 lies in the region of the mouth of the depression 47. The depression 47 preferably has a depth that increases towards the mouth of the depression 47, as may be seen in FIGS. 2A, 3A and 3B. This allows an index finger, for example, to be inserted between the depression 47 and the locking plate 41. The width of the depression 47 may also increase towards the lateral mouth. The depression 47 is therefore delimited by a U-shaped edge of the upper face of the lid 31.

More generally, the shape of the depression 47 is chosen so that its mouth is wide enough that the user can easily hold the actuating region of the locking plate 41 between two digits. The locking plate 41 can therefore pivot into the depression 47 to adopt the unlocked position. The locking plate has a significant travel thanks to the depression 47 in the lid 31. By way of nonlimiting example, the free end 42 of the actuating portion 410 may lie at least three times further away from the pivot axis 400 than does the free end 43 of the catching portion 420. The plate 41 can therefore behave like a lever, with the lever by default returning to the engagement position to encourage locking.

Figure 5:
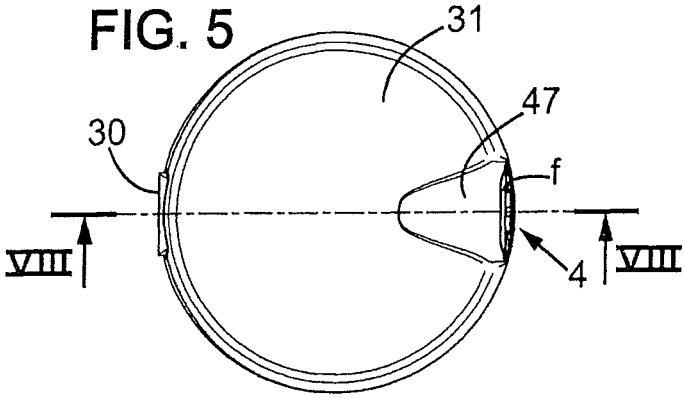
FIG. 5 is a top view of the lid.

As illustrated in FIG. 8 with the lid 31 closed, the locking plate 41 extends in the continuation of the peripheral side wall 220 in the engagement position. Thus, the lid 31 has an outline that has no protrusion, allowing several closure systems 3 to be stacked. FIG. 5 illustrates the continuity of the outline of the lid 31. As a result, the entire locking device 4 is integrated into the exterior profile of the entire lid 31, and even of the entire packaging 1, because of the correspondence between the profile of the lid 31 and of the part that forms a container 2 when the lower end of the lid 31 is resting on the upper face of the surround 32.

Figure 9:
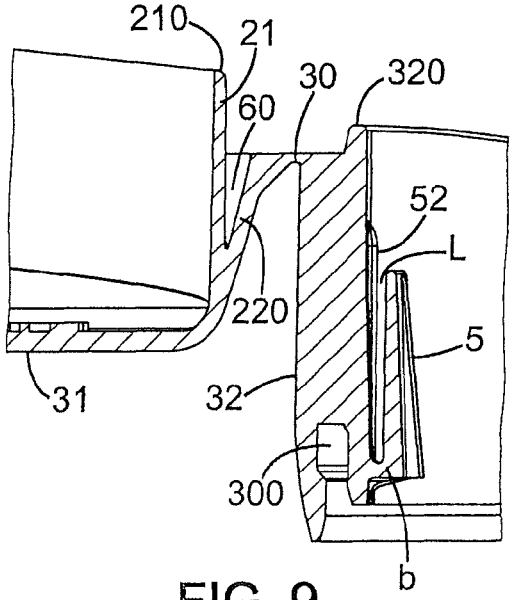
FIG. 9 is a view, on the same plane of section as for FIG. 1, illustrating the complementary shapes of the surround and the lid in greater detail.

With reference to FIGS. 3A, 3B, 5 and 9, the locking plate 41 is connected to the side wall 220 of the lid 31 by at least two elements 440 of an elastic hinge. Formed between these two elements 440 is a space f adjacent to the depression 47. This space f lies in the continuation of a continuous groove 60 formed between the side wall 220 and an interior skirt 21 of the lid 31. As illustrated in FIG. 9, the surround 32 has an upper face that has an annular projection 320 extending in the continuation of the interior face of the side wall of the surround 32. A projection comprising the engagement rim 33 extends from this annular projection in an upwards direction. The profile of the engagement rim 33 may be simply rectangular. The engagement rim 33 projects for example in the opposite direction to the central axis Z so as to have a free end situated near the interior face of the locking plate 41. When the lid 31 is in the closed position, the engagement rim 33 fits into the space f between the side wall 220 and the catching portion 420, pressing against the side wall 220.

In the embodiment depicted, the engagement rim 33 consists of a portion of the surround 32 situated facing the locking lug 41, and more specifically positioned on the exterior periphery of the upper face of the surround 32.

Figure 3A:
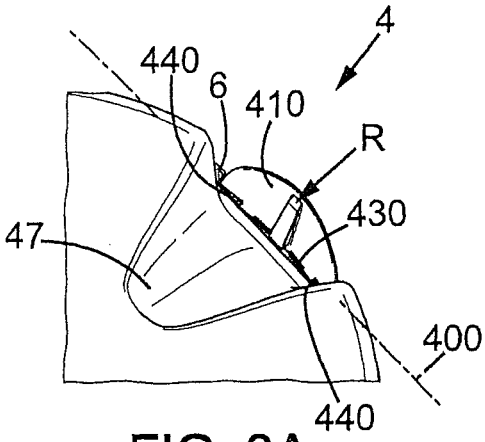
FIGS. 3A and 3B depict two perspective views of the part of the locking device connected to the lid.

It should be noted that the cross section of the locking plate 41 is not necessarily a perfect rectangle. The radially inner face of the locking plate 41 may have one or more ribs to alter its rigidity, and therefore the force needed to move the free end 43 away from the engagement rim 33. As illustrated in FIGS. 2A, 2B and 3A, the locking plate 41 may thus have a rib or similar reinforcing element R projecting towards the central axis Z. This reinforcing element R extends over the space f and may constitute an end stop for the upper face of the engagement rim 33 when the lid 31 is in the closed position.

With reference to FIG. 2B, the engagement rim 33 may extend the mouth of the depression 47 when the lid 31 is in the closed position. The projecting portion of the surround 32 that defines the engagement rim 33 may close off the space f and be urged radially outwards by the side wall 220 of the lid 31. Thus, the projection of the surround 32 by default nestles under the reinforcing element R when the lid 31 is in the closed position, as long as the pivoting locking plate 41 is not being actuated by the user.

The catching portion 420 may have one or more pegs 430 directed radially inwards with respect to the central axis Z and engaging with the engagement rim 33 from underneath in the locked position. Each peg 430 has the overall shape of a projecting rib running horizontally across the interior face of the locking plate 41 with a trapezoidal profile, a quadrant profile or substantially triangular profile. By way of example, two spaced-apart pegs 430 may thus extend with increasing thickness from the free end 43 of the catching portion 420 as far as a substantially horizontal level adjacent to the axis 400 of pivoting of the locking plate 41.

A clip-fastening effect is thus obtained by virtue of the pegs 430 of the catching portion 420. Nonetheless, in order to achieve such clip fastening, it is not strictly necessary for the pegs 430 or the catching portion 420 necessarily to have such a profile. Indeed, at least one peg 430 could have a different profile, for example being the form of a bead, particularly when the engagement rim 33 has a profile significantly different from that of a rectangle.

The lid 31 can therefore no longer pivot about the axis defined by the hinge 30 positioned on the opposite side to the locking device 4, nor can it be raised through a translational movement. In other words, it will thus be appreciated that in the locked position it is possible for the packaging 1 to be carried by the region of the locking plate 41 that is intended for grasping, without causing the lid 31 to open, provided that the actuating portion 410 has not been pivoted towards the depression 47 in the lid 31.

The purpose of the locking device 4 is to prevent unwanted spillage of product after first opening when the inner seal 24 has been removed, but it is not intended to achieve the kind of sealed closure obtained previously using the inner seal 24.

In the embodiment of FIGS. 2A to 3B, the lid 31 also comprises tamper-evident features 6 with frangible connections, associated with the locking plate 41 to form a tamper-proofing device indicating that the packaging 1 has not been tampered with. More specifically in the exemplary embodiment depicted, each of the tamper-evident features 6 is in the form of a plastic tooth formed as an integral part of the lid 31. The tamper-evident feature 6 is attached on at least one side to the side wall 220 of the lid 31. One or more frangible connections in the form of frangible bridges of material connect the tamper-evident feature 6 to a lateral edge of the locking plate 41.

Figure 3B:
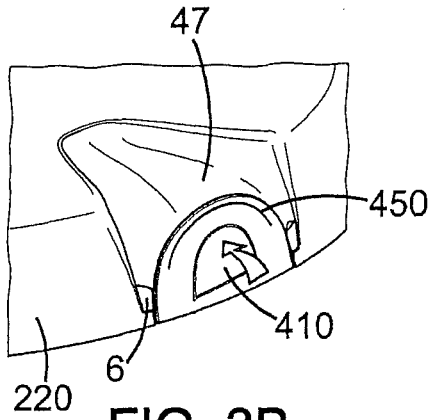

In the embodiment of FIGS. 3A and 3B, the tamper-evident features 6 are of trapezoidal shape and the frangible connection lies on a vertex distant from the side wall 220. The locking plate 41 has a semicircular edge to which the tamper-evident features 6 are attached frangibly prior to first opening of the lid 31. The frangible connections to the tamper-evident features 6 are preferably situated to the side on each side of a mid plane of the plate 41 parallel to the central axis Z and in such a way as not to interfere with the operation of the locking plate 41. In the embodiment depicted, the mid plane of the locking plate 41 is a plane of symmetry which passes through the central axis Z. The axis 400 of pivoting of the locking plate 41 is orthogonal to this mid plane.

Each of the tamper-evident features 6, of which there are preferably two, is positioned at the mouth of the depression 47 and each tooth that forms the tamper-evident feature 6 is shaped in such a way as to extend in the continuation of the exterior profile of the entire lid 31. This gives the packaging 1 a particularly attractive appearance and limits the possibility of it catching on anything during its working life. In addition, the fact that the tamper-evident features 6 are secured to the lid 31 prevents any possibility of these features 6 dropping into the container 2. In the example of FIGS. 3A and 3B, these tamper-evident features 6 are connected to the side wall 220 of the lid 31 at the edge formed between a lateral face of the depression 47 and a face of the lateral periphery of the lid 31.

Mention has been made here of one frangible bridge of material per tamper-evident feature 6 but of course the number of bridges of material and the layout of such bridges could differ substantially. For example, one tamper-evident feature 6 could partially cover the front or rear surface of the locking plate 41.

The working life of the packaging 1 may run as follows. The injection-moulding of the entire closure device 3 with the locking and tamper-proofing devices (4, 6) yields a single component that can be configured in the closed position with the lid 31 folded down onto the surround 32. Thanks to the locking devices 4 and the tamper-proofing devices, this configuration is maintained.

The closure device 3 thus formed may then easily be fitted onto the container 2 which has been already filled and provided with its inner seal 24, for example using clip fastening. The packaging 1 is then ready for sale. Any manual attempt at opening it will cause at least one of the frangible connections to rupture and this will generally be readily perceivable by the consumer.

At the time of first use, the user will, by pivoting the plate 41, break the frangible connections of the tamper-evident features 6. The fact of thus unlocking the locking device 4 allows the lid 31 to be moved. Through a pressure applied to the exterior region, visible in FIG. 3B, of the actuating portion 410 and a slight upwards pulling movement, the user can then bring the lid 31 into the open position. As illustrated in FIGS. 3A and 3B, a projecting rib 450 may be provided on the exterior face of the actuating portion 410, this for example having the same shape as the free edge of the actuating portion 410 (a C-shape in the embodiment depicted). This rib 450 provides a better purchase for the thumb when exerting pressure on the actuating portion 410 for unlocking purposes and improves the effectiveness of this action.

When the packaging 1 is resealed, that is to say when the lid 31 is folded back down, locking is brought about automatically by the clip fastening of the catching portion 420 on the engagement rim 33. Thereafter, for a further use, all that is required is for pressure to be applied once again to the central region of the actuating portion 410 in order to release the locking device 4.

One way of attaching a measuring utensil 100 that is permitted by packaging 1 according to the invention will now be described in conjunction with FIGS. 1 and 6 to 9.

With reference to FIG. 1, the lid 31 may be domed and of significant height (for example between 2 and 5 cm tall). The lid 31 thus has a side wall 220 that makes it easier to handle and a top wall P able to cover the opening 230. One or more items, particularly a measuring utensil 100 when the packaging contains powdered milk, may then be stored in the interior volume defined by the lid 31. In the embodiment depicted, the lid 31 is articulated to the surround 32 and the interior volume used for storing the measuring utensil 100 lies between the opening 230 of the container and the top wall P of the lid 31 in its closed position.

Initially, the measuring utensil 100 may be wrapped in a bag and placed between the inner seal 24 and the lid 31 in the packaging 1 ready for sale. The measuring utensil 100 has a bowl 15 connected to a handle 16. The dimensions, particularly the length, of the utensil, allow this utensil to be positioned in the plane of the surround 32. In the case of a container 2 of circular design, it will be appreciated that the length of the measuring utensil 100 remains smaller than the inside diameter of the surround 32.

In order not to give rise to contact liable to contaminate the food, a single region is provided on the radially inner side wall of the surround 32 to which the measuring utensil 100 will be secured in the upper part of the packaging 1, via its bowl 15. The surround 32 may here with equal preference correspond either to a part of the container 2 or to an element attached to the container 2, as those skilled in the art will appreciate. As illustrated in FIG. 8, the inner side wall comprises at least one retaining member which has a base b extending from the surround 32 towards the central axis Z of the container 2 and which is extended by a tab 5 extending upwards some distance from the interior wall of the surround 32. The retaining member delimits, with this inner side wall, an insertion housing L capable with a small amount of clearance of accommodating a wall portion of the bowl 15 of the measuring utensil 100. The tab 5 may be ribbed to increase its rigidity, for example with two parallel ribs 55 projecting towards the central axis Z.

The function performed by the retaining member is to wedge the bowl wall portion inserted in the housing L. To do that, the tab 5 may have a profile that is rectangular overall or more generally tailored to the shape of the wall of the bowl 15 of the measuring utensil. At least a portion of the tab 5 may be parallel to the central axis Z. The tab 5 may have at least one free end in contact with the wall portion of the bowl 15 inserted in the housing L.

With reference to FIG. 8, the tab 5 of the retaining member comprises an upper free end positioned, when the lid 31 is in the closed position, with a determined separation from the top wall P when the lid 31 is in the closed position. This determined separation is less than the depth of the bowl 15 so as to prevent the bowl portion 15 inserted in the insertion housing L from leaving this housing L, as this might cause the measuring utensil 100 to drop down inside the container 2. FIG. 7 illustrates the position of the measuring utensil 100 at the surround 32 secured by the retaining member. The handle 16 is clear of the surround 32 and can be readily grasped by the user in order to make use of the measuring utensil 100. Alternatively, the bowl 15 may be retained using a bowl position that is the inverse of that shown in the example of FIG. 7, with the bowl opening uppermost. In that case, the tab 5 may fit into a hollow delimited in the bottom of the bowl. More generally, one or more tabs of the aforementioned type may be used to grip at least one wall portion of the bowl 15.

In a preferred embodiment, the retaining member comprises at least three bearing regions each applying pressure to the wall portion of the bowl 15 in order to clamp the bowl 15 of the measuring utensil 100. Two of these bearing regions are, for example, each formed of a rib 52 of the inner side wall of the surround 32, protruding towards the central axis Z. The third bearing region is provided by the side of the tab 5 facing the inner side wall of the surround 32.

Figure 6:
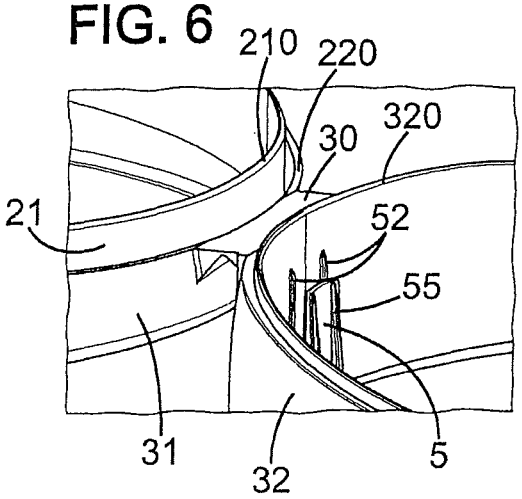
FIG. 6 is a perspective view detailing the region where the lid meets the surround.

With reference to FIGS. 6 and 9, ribs 52 with an essentially vertical component are thus provided on the inner side wall of the surround 32, in contact with the exterior of the wall portion of the bowl. These ribs 52 for example perform both a clamping and a guiding function. In the embodiment depicted, the thickness of the ribs 52 decreases towards the closed end of the housing L, which closed end is formed by the base b of the retaining member. This configuration of ribs 52 produces an initial axis of insertion into the housing L of the bowl 15 wall portion that is slightly inclined with respect to the direction of the central axis Z, as can be seen in FIG. 9. However, the tab 5 extends in an overall direction that is substantially parallel to the central axis Z. For a bowl with a roughly cylindrical wall, it will therefore be appreciated that when the wall portion of the bowl 15 has been fully inserted into the housing L, the thickest portion of the ribs 52 will then more firmly grip the bowl 15 wall portion positioned in the housing L.

In the embodiment in which there is an elastic hinge 30 connecting the lid 31 to the surround 32, the single catching region is located on the hinge 30 side. As illustrated in particular in FIG. 7 with a surround in the form of a ring attached to the container 2, the height of the surround 32 is at a maximum H2 at the retaining member side, the height decreasing on either side of this maximum H2, preferably gradually, down to a reduced height on the side opposite this retaining member. In order to put the bowl 15 of the measuring utensil 100 in position on the retaining member, it is necessary to hold the handle on that side of the surround 32 where the height is the lowest so that the bowl 15 can be brought in close to the retaining member. With this reduction in the height of the surround 32, the measuring utensil 100 can be secured and removed intuitively, unimpeded by the surround 32, by grasping hold only of the free end of the handle 16.

With reference to FIGS. 1 and 5, the lid 31 may have a plane of symmetry which corresponds to the plane of section of FIG. 1. This plane of symmetry may include the central axis Z and pass respectively and centrally through the hinge 30, the depression 47 and the plate 41 of the locking device. In the embodiment depicted with the hinge 30, the profile of the lid 31 complements the profile of the surround 32. The maximum height H2 of the surround 32 thus lies on the hinge 30 side, while the maximum height H1 of the lid 31 lies opposite, that is to say on the same side as the locking device 4 in the example depicted. The lid 31 therefore has a minimum height on the hinge 30 side. This minimum is, for example, of the order of 1 or 2 cm and the maximum height H1 of the lid 31 is about twice or three times this minimum. The height of the measuring utensil 100 in the position in which it is secured to the retaining member (and which substantially corresponds to the depth of the bowl 15) typically ranges between 1 and 3 cm. The measuring utensil 100 can therefore be positioned under the lid 31 in the closed position, housed inside the volume defined by the lid 31 and the surround 32.

A lid 31 design suitable for food packaging according to the invention and intended for powdered milk will now be described more particularly in conjunction with FIGS. 4 and 6 to 9.

As can be seen in FIGS. 6 and 9, the lid 31 comprises an interior skirt 21 which, with the exterior side wall 220 of the lid 31 defines a continuous groove 60. This groove 60 may completely surround the interior skirt 21. In the exemplary embodiment of FIGS. 8 and 9, the side wall 220 diverges radially from the central axis Z towards a free edge of this side wall 220. The interior skirt 21 on the other hand is substantially cylindrical about the central axis Z for example. The interior skirt 21 and the side wall 220 preferably share this same central axis Z in a coaxial configuration.

With reference to FIGS. 4, 6 and 7, the surround 32 has an upper face which delimits a wide opening 230 via which the user can, using a suitable tool, make use of the powdered milk or similar contents. The upper face of the surround 32 has an annular projection 320 that fits into the groove 60 when the lid 31 is in the closed position. This annular projection 320 of the surround 32 thus plays a part in centering the lid 31 as it closes.

The annular projection 320 advantageously extends in the continuation of the inner face of the side wall of the surround 32. Thus, the inside of the surround has a continuous appearance preferably without any rim or lip. In the embodiment depicted, the retaining member for the bowl 15 of the measuring utensil 100 lies at a lower level than the annular projection 320. With the exception of this retaining member, the entire inner side wall of the surround 32 located above the inner seal 24 is smooth. There is therefore, where the surround meets the lid 31, no surface such as an interior rim on which powdered milk could become deposited. In practical terms, the lid 31 thus arranged can be closed unimpeded.

With reference to FIG. 8, in the closed position, the annular projection 320 fits into the groove 60 without, however, reaching the bottom of this groove 60. The height of the annular projection 320 ranges, for example, between 1 and 4 mm. It should be noted that the annular projection 320 runs predominantly below a plane orthogonal to the central axis Z and passing through the axis of articulation of the hinge 30. In FIGS. 1, 4 and 7 it may be seen that only part of the annular projection 320 near the hinge 30 protrudes above this plane (which in the example of FIG. 1 is horizontal) that passes through the hinge 30.

The interior skirt 21 covers, preferably continuously, an upper strip of the inner side wall of the surround 32 in this closed position and may thus, via its entire periphery, fit against the inside of the surround 32. The free end 210 of the interior skirt 21 is rounded or chamfered to make contact between the interior skirt 21 and the inner side wall of the surround 32 more gradual as the lid 31 is being lowered.

The interior skirt 21 may, on the side nearest the hinge 30 and on its interior face, have one or more projecting contact surfaces which, as the lid 31 is being closed, press against the bowl 15 housed in the retaining member. This pressure pushes the bowl wall portion inserted into the housing L towards the base b. The projecting surface may be chamfered in order to obtain this effect of pushing the bowl 15 of the measuring utensil 100 deeper into the housing L. The effect afforded by the projecting surface could, alternatively or in addition, cause the bowl to begin to lift during the operation of opening the lid 31. On the opposite side to the hinge 30, it should be noted as illustrated in particular in FIG. 7 that the depression 47 locally narrows the tubular volume defined by the interior skirt 21.

With reference to FIG. 9, the surround 32 comprises a peripheral exterior face with respect to which the annular projection 320 is offset inwards. In the closed position, the exterior edge of the surround 32 adjacent to the annular projection 320 is covered by the edge of the side wall 220 as can be seen in FIG. 8. This edge-to-edge form of meeting means that the entire surround-lid assembly can maintain a smooth exterior profile, the exterior skirt formed by the side wall 220 meeting and continuing the exterior face of the surround 32 in the closed position.

The side wall 220 and the interior skirt 21 meet and, in vertical section, form the arms of a Y, as illustrated in FIGS. 8 and 9. The side wall 220 of the lid 31 is preferably in radial contact with the annular projection 320 when the lid 31 is in the closed position. Because the interior skirt 21 designed to cover the inside of the entire annular projection 320 of the surround 32 is also in radial contact with this annular projection 320 in the closed position, it will be understood that the closure is advantageously better sealed.

With reference to FIGS. 1 and 8, the profile where the lid 31 meets the surround 32 is curved and oblique overall, with the maximum height H1 of the lid 31 on the opposite side to the hinge 30. In the embodiment depicted, the profile of the side wall 220 of the lid 31 has a height that decreases gradually towards the hinge 30. Correspondingly, the surround 32 has a side wall the height of which decreases gradually as far as the region in which the engagement rim 33 is situated.

As can be seen in FIGS. 6 and 7, the annular projection 320 has a preferably constant height and therefore has the same oblique profile as the side wall of the surround 32. The oblique profile of the meeting point from the hinge 30 and the rounded or chamfered shape to the free end of the interior skirt 21 makes the engagement of the interior skirt 21 with the inner side wall of the surround 32 more gradual as the lid 31 is being closed. As a result, the force applied by the user is more continuous, improving the comfort of use. What actually happens is that any abrupt engagement of the lid 31 with the surround 32 which would generate a hard contact point is avoided. The interior skirt 21 may extend under the level at which the lid 31 and the surround 32 meet edge to edge in the closed position.

According to an embodiment that has not been depicted, the lid 31 may have radial ribs projecting from the interior skirt 21 towards the inside of the lid 31 to stiffen the latter. These ribs are, for example, of triangular profile and meet the top wall P of the lid 31.

Of course, the embodiment described hereinabove is non-limiting and numerous alternatives regarding the geometry of the components that make up the locking and tamper-proofing devices or the bowl 15 retaining device may be produced without departing from the scope of the invention as claimed. In particular, although the closure system 3 has been described as being in two parts with a lid 31 which is articulated or, more generally, removable with respect to a surround 32 which is mounted on the container 2, it is clear that the lid 31 may close off the opening 230 by being fitted directly onto a container 2 of corresponding shape, with or without a hinged articulation.

The invention claimed is:

1. Packaging for a food product comprising:

a container extending along a central axis from a base to an upper face that has an opening;

an annular frame mounted as a close fit on an upper part or neck of the container, the frame having an interior face and an upper face that has an annular projection;

a lid mounted articulated with respect to the frame between an open position and a closed position in which the lid closes off the opening of the container, the lid having a top wall, a side wall extending from the top wall and an interior skirt, a continuous groove being defined between the side wall and the interior skirt, said frame and said lid forming a closure system;

a measuring utensil provided with a bowl, which is adapted to be stored in an interior volume defined by the closure system;

wherein, in the closed position, the annular projection is inserted into the continuous groove and the interior skirt presses at least partially against said interior face of the frame, and wherein said annular projection extends in the continuation of the interior face of the frame so that no rim or lip of the annular frame is in contact with the interior skirt in the closed position.

2. The packaging according to claim 1, wherein the continuous groove is deeper than wide.

3. The packaging according to claim 1, wherein the container has a cylindrical shape and the central axis is an axis of symmetry for both the container and the interior face of the frame.

4. The packaging according to claim 1, wherein the frame has an exterior peripheral face with respect to which said annular projection is offset inwards, the side wall of the lid extending in the continuation of said exterior face of the frame in the closed position.

5. The packaging according to claim 1, wherein the top wall of the lid comprises a depression opening into the side wall and arranged at the opposite of a hinge connecting the frame to the lid in an articulated manner.

6. The packaging according to claim 5, comprising a locking device movable into said depression.

7. The packaging according to claim 1, wherein the lid has a height, which is between 2 and 5 cm.

8. The packaging according to claim 1, wherein the interior skirt has a free end that is chamfered on its outside and fits via its entire periphery against the interior face of the frame.

9. The packaging according to claim 1, wherein the frame comprises a retaining member with a tab which, with the interior face of the frame, delimits a housing that is open at the top and intended to accommodate a wall portion of the bowl of the measuring utensil, the interior skirt extending, when the lid is in the closed position, up to the vicinity of said housing in order to collaborate with the bowl housed in the housing.

10. The packaging according to claim 1, wherein the lid comprises radial ribs projecting from the interior skirt inwardly and that meet the top wall of the lid.

11. The packaging according to claim 1, wherein the frame has an exterior edge adjacent to the annular projection, the exterior edge of the frame being in contact, when the lid is in the closed position, with a free edge of the side wall, the free edge of the side wall having a width identical to the width of said exterior edge.

12. The packaging according to claim 1, comprising a hinge connecting the frame to the lid in an articulated manner, the height of the lid being superior to the height of the frame at the opposite of the hinge.

13. The packaging according to claim 1, wherein said interior face of the frame comprises a cylindrical area that extends upwardly to as said annular projection, and wherein, in the closed position, the annular projection is inserted into the continuous groove and the interior skirt presses at least partially against said cylindrical area of the interior face of the frame.

14. Packaging for a food product comprising:

a container extending along a central axis from a base to an upper face that has an opening;

an annular frame mounted as a close fit on an upper part of the container, the frame having an interior face and an upper face that has an annular projection;

a lid mounted articulated with respect to the frame between an open position and a closed position in which the lid closes off the opening of the container, the lid having a top wall, a side wall extending from the top wall and an interior skirt, a continuous groove being defined between the side wall and the interior skirt, said frame and said lid forming a closure system;

a measuring utensil provided with a bowl, which is adapted to be stored in an interior volume defined by the closure system;

wherein said interior face of the frame comprises a cylindrical area that extends upwardly to said annular projection, and wherein, in the closed position, the annular projection is inserted into the continuous groove and the interior skirt presses at least partially against said cylindrical area of the interior face of the frame.

* * * * *